US009184513B2

(12) United States Patent
Tanigawa et al.

(10) Patent No.: US 9,184,513 B2
(45) Date of Patent: Nov. 10, 2015

(54) TERMINAL FITTING

(71) Applicant: Sumitomo Wiring Systems, Ltd., Yokkaichi (JP)

(72) Inventors: Norihiko Tanigawa, Yokkaichi (JP); Takeshi Tsuji, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 14/491,171

(22) Filed: Sep. 19, 2014

(65) Prior Publication Data

US 2015/0087192 A1 Mar. 26, 2015

(30) Foreign Application Priority Data

Sep. 20, 2013 (JP) ..... 2013-195907

(51) Int. Cl.

| | |
|---|---|
| ***H01R 13/11*** | (2006.01) |
| ***H01R 4/18*** | (2006.01) |
| ***H01R 13/187*** | (2006.01) |
| *H01R 43/16* | (2006.01) |

(52) U.S. Cl.

CPC ..... *H01R 4/18* (2013.01); *H01R 4/185* (2013.01); *H01R 13/11* (2013.01); *H01R 13/187* (2013.01); *H01R 43/16* (2013.01)

(58) Field of Classification Search

CPC ..... H01R 13/04; H01R 13/11; H01R 13/111–13/115; H01R 13/15; H01R 13/187; H01R 13/193; H01R 13/2442; H01R 11/22; H01R 43/16; H01R 2101/00

USPC ..... 439/842, 844, 845, 850–856, 862

See application file for complete search history.

(56) References Cited

U.S. PATENT DOCUMENTS

| | | | | |
|---|---|---|---|---|
| 5,427,553 | A * | 6/1995 | Tsuji | 439/851 |
| 5,624,289 | A * | 4/1997 | Kourimsky et al. | 439/852 |
| 5,836,793 | A * | 11/1998 | Chaillot et al. | 439/852 |
| 6,171,155 | B1 | 1/2001 | Miwa et al. | |
| 7,503,813 | B1 * | 3/2009 | Osterhart | 439/852 |
| 7,513,806 | B2 * | 4/2009 | Noda et al. | 439/852 |

* cited by examiner

*Primary Examiner* — Neil Abrams
*Assistant Examiner* — Travis Chambers
(74) *Attorney, Agent, or Firm* — Gerald E. Hespos; Michael J. Porco; Matthew T. Hespos

(57) ABSTRACT

A male terminal (90) is inserted into a tubular main body (11) and a resilient contact piece (13) separate from the main body (11) is deflectably arranged in the main body (11). The main body (11) includes crimping pieces (27) to be crimped and fixed to crimping regions (33) of the resilient contact piece (13). Protrusions (28, 36) which bite into mating sides at the time of crimping are provided on crimping surfaces (38, 39) along which the crimping pieces (27) and the crimping regions (33) are crimped to each other.

17 Claims, 9 Drawing Sheets

TERMINAL FITTING

BACKGROUND

1. Field of the Invention

The invention relates to a terminal fitting.

2. Description of the Related Art

U.S. Pat. No. 6,171,155 discloses a terminal fitting with a tubular main body (electrical contact portion). A resiliently deflectable contact piece is separate from the main body and is arranged in the main body. A mating male terminal is inserted into the main body and a contact portion of the resilient contact piece resiliently contacts the inserted male terminal so that the terminal fitting is connected electrically to the male terminal. Front and rear free end parts of the resilient contact piece are slidably locked to opposite front and rear end parts of a bottom wall.

The bottom wall of the main body may require structure for locking the resilient contact piece in a fixed state to achieve stability in connection to the male terminal, manufacturing ease and the like. In that case, it has been considered to provide either one of the resilient contact piece and the bottom wall of the main body with a crimping piece to be crimped and fixed to a mating side. However, if a crimping force of the crimping piece is insufficient, the crimping piece may possibly displace relative to the bottom wall of the main body and connection reliability to the male terminal may not be ensured.

The invention was completed based on the above situation and aims to provide a terminal fitting capable of ensuring connection reliability to a male terminal by stably fixing a resilient contact piece to a main body portion.

SUMMARY OF THE INVENTION

The invention, there is provided a terminal fitting, including a main body portion which is formed into a substantially tubular shape and into which a male terminal is to be inserted. The terminal fitting further includes a resilient contact piece that is separate from the main body portion and deflectably arranged in the main body for resiliently contacting the inserted male terminal. One of the main body and the resilient contact piece includes at least one crimping piece to be crimped and fixed to a mating side. At least one crimping surface along which the crimping piece and the mating side are crimped to each other includes a protrusion that bites into the other crimping surface during crimping.

The main body and the resilient contact piece may have different hardnesses.

The protrusion may be provided on the harder of the main body and the resilient contact piece. Thus, the protrusion can bite more strongly into the one of the main body and the resilient contact piece that has the lower hardness, so that fixing strength of the resilient contact piece to the main body is increased.

The protrusion may define a rib that extends in a direction intersecting an inserting direction of the male terminal. Thus, a locking action of the protrusion acts in the inserting direction of the male terminal into the main body, and connection reliability to the male terminal is improved.

The protrusion may be provided on both crimping surfaces along which the crimping piece and the mating side are crimped.

The protrusions may extend in rib-like manners and may contact each other in an intersecting manner at the time of crimping. Thus, a hooking structure is formed between the protrusions for reliably suppressing displacement between the crimping piece and the mating side.

At least one confirmation hole may penetrate the main body, and the resilient contact piece may comprise at least one protrusion. The protrusion may be at the confirmation hole of the main body when the resilient contact piece is arranged in the main body. Thus, a state of the resilient contact piece can be confirmed by detecting the protrusion through the confirmation hole.

The at least one protrusion may protrude laterally at a position substantially facing a contact portion of the resilient contact piece with the male terminal. The protrusion may be provided at a side edge of the resilient contact piece.

At least one mold removal hole may be provided in the main body in a position adjacent to the confirmation hole.

The crimping piece may be in the form of a strip cantilevered from an inner edge part toward an outer edge part of the mold removal hole in a width direction in a development state.

These and other objects, features and advantages of the invention will become more apparent upon reading the following detailed description of preferred embodiments and accompanying drawings.

DETAILED DESCRIPTION

Figure 1:
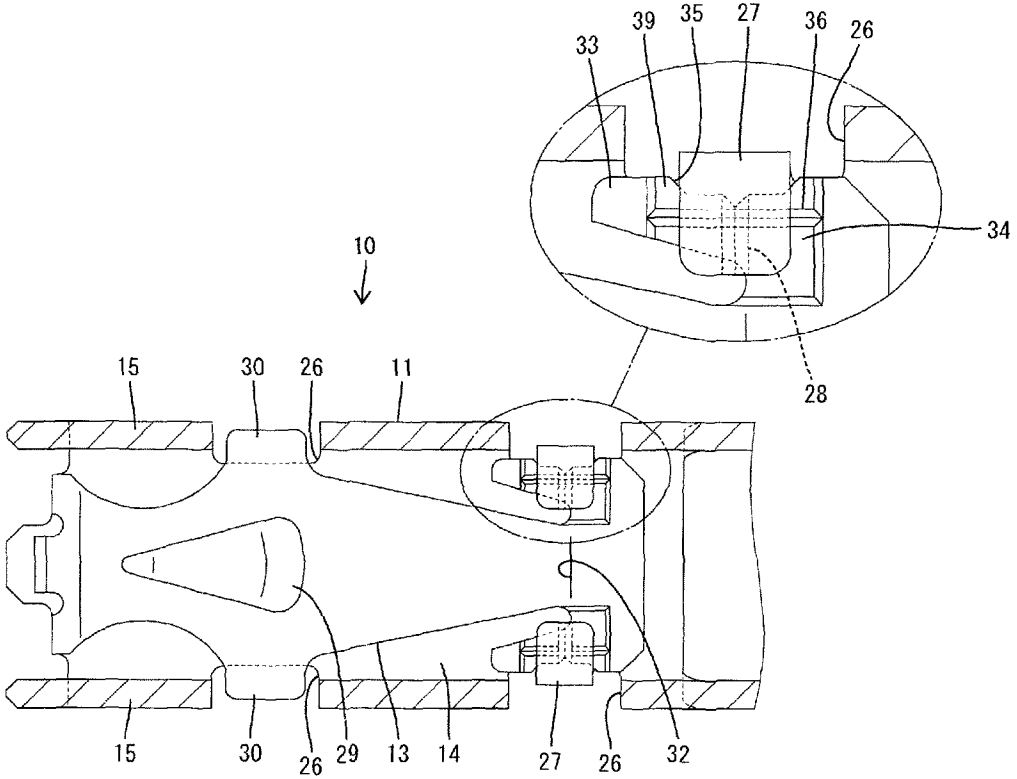
FIG. 1 is a section showing a resilient contact piece arranged in a main body portion of a terminal fitting in one embodiment of the present invention.

A terminal fitting in accordance with an embodiment of the invention is identified by the numeral 10 in FIGS. 1 to 9. The terminal fitting 10 of this embodiment is formed by bending, folding and/or embossing an electrically conductive metal plate and includes a main body 11, at least one barrel 12 and a resilient contact piece 13. The main body 11 and the barrel 12 are unitary with each other and the resilient contact piece 13 is separate from the main body 11 and the barrel 12. Further, the resilient contact piece 13 is formed to have a higher hardness than the main body 11 and the barrel 12. Note that, in the following description, a side where a mating male terminal 90 (see FIG. 6) is located when the terminal fitting 10 is connected to the mating male terminal 90 is referred to as a front concerning a front-back direction, and a vertical direction is based on FIGS. 2 to 4.

Figure 3:
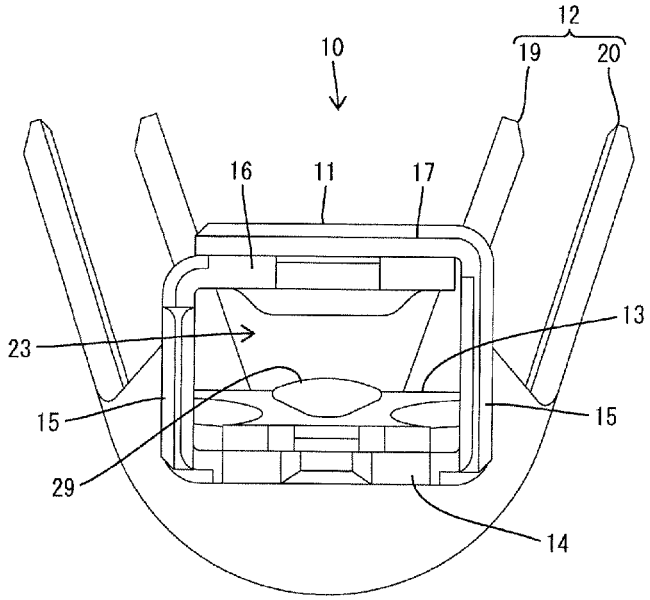
FIG. 3 is a front view of the terminal fitting.
Figure 4:
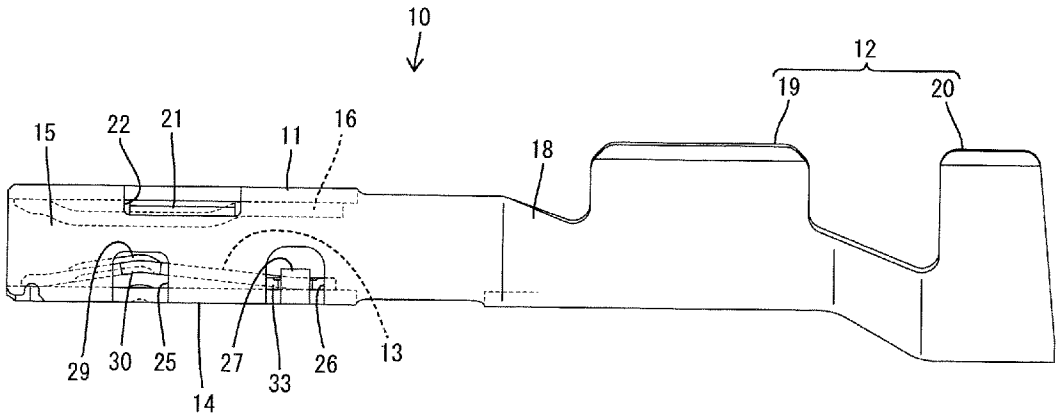
FIG. 4 is a side view of the terminal fitting.

As shown in FIGS. 3 and 4, the main body 11 has a rectangular tubular shape and comprises a bottom wall 14 extending in a width direction, first and second opposed side walls 15 standing up from opposite widthwise sides of the bottom wall 14, a first ceiling wall 16 extending from the upper end of the first side wall 15 toward the second side wall 15 and a second ceiling wall 17 extending from the upper end of the second side wall 15 toward the first side wall 15 and laid on the upper surface of the first ceiling wall 16.

Figure 5:
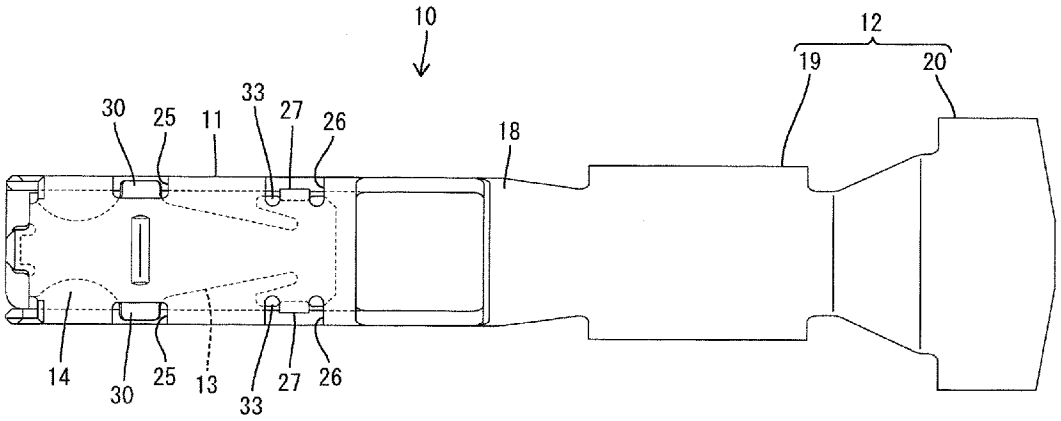
FIG. 5 is a bottom view of the terminal fitting.

As shown in FIGS. 4 and 5, the barrel 12 is arranged behind the main body 11 and a coupling portion 18 is interposed between the main body 11 and the wire barrel 12). Specifically, the barrel 12 comprises a wire barrel 19 to be crimped, bent or folded and connected to a core exposed at an end part of) an unillustrated wire and an insulation barrel 20 located behind the wire barrel 19 and to be crimped, bent or folded and connected to an insulation coating of the wire or an unillustrated rubber plug mounted on the insulation coating. As shown in FIG. 4, the bottom surface of the insulation barrel 20 is located below that of the wire barrel 19.

Figure 6:
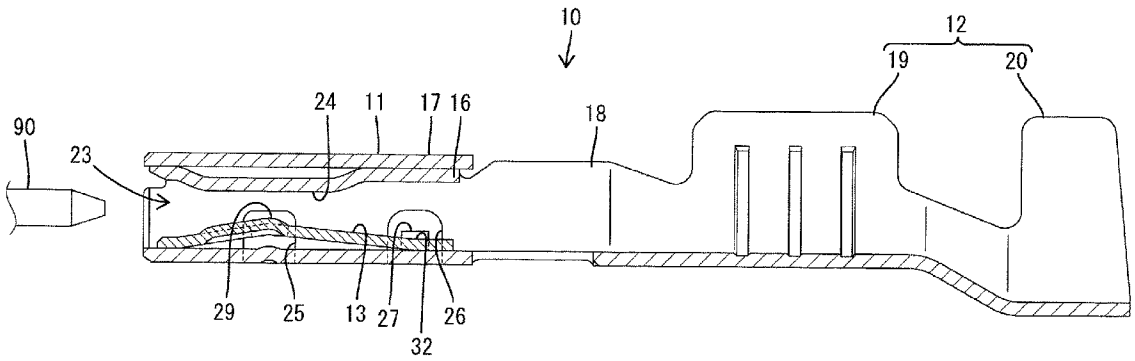
FIG. 6 is a section of the terminal fitting when viewed laterally.
Figure 9:
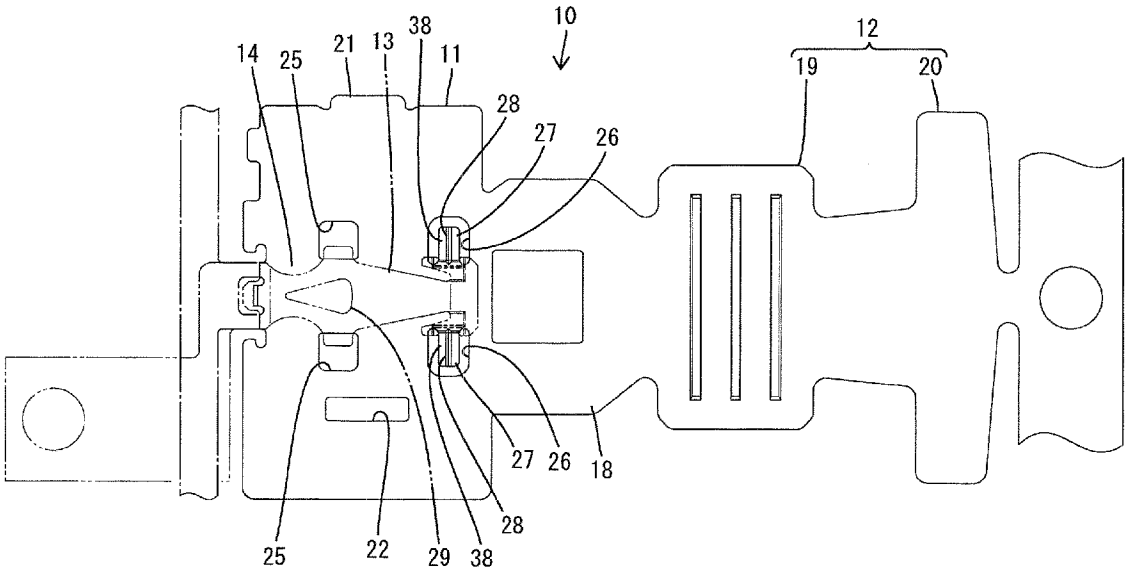
FIG. 9 is a development of the terminal fitting.

As shown in FIGS. 4 and 9, a holding piece 21 projects on an extending tip part of the first ceiling wall 16 and a holding hole 22 penetrates on an extending base end part of the second ceiling wall 17 and the second side wall 15. The tubular shape of the main body 11 can be maintained by inserting and locking the holding piece 21 into the holding hole 22. The resilient contact piece 13 is arranged in the main body 11 in a state fixed to the bottom wall 14, and a forwardly open insertion space 23 is between the resilient contact piece 13 and the first ceiling wall 16, as shown in FIG. 6, for receiving the male terminal 90. Further, a receiving portion 24 extends in the front-back direction and projects down (toward the insertion space 23) from the first ceiling wall 16. Note that the male terminal 90 is in the form of a tab extending in the front-back direction.

As shown in FIGS. 4 and 5, two confirmation holes 25 penetrate lower parts of both side walls 15 and the bottom wall 14, and two mold removal holes 26 penetrate these lower end parts and the bottom wall 14 behind the confirmation holes 25. Crimping pieces 27 are arranged inside the mold removal holes 26 of the main body portion 11.

As shown in FIG. 9, the crimping piece 27 is in the form of a strip extending in a cantilever manner from an inner edge part toward an outer edge part of the mold removal hole 26 in the width direction in a development state. The upper surface (crimping surface 38 for a crimping region 33 to be described later) of the crimping piece 27 is located below the upper surface of the bottom wall 14, and the crimping piece 27 is made thinner than the bottom wall 14 by press-working (see FIG. 2). A rib-like protrusion 28 (protrusion on the side of the main body portion 11) extending in an extending direction of the crimping piece 27 (direction perpendicular to an inserting direction of the male terminal 90 into the main body portion 11, and width direction in the development state) is provided on the upper surface of the thinned crimping piece 27. The protrusion 28 has a triangular cross-section with an acute tip (see FIG. 2) and extends over the entire length of the crimping piece 27. The tip end (upper end) of the protrusion 28 is arranged at a height substantially flush with the upper surface of the bottom wall 14 in the development state.

As shown in FIG. 6, the resilient contact piece 13 is in the form of a strip extending in the front-back direction and is formed to have an inverted V shape side view by being bent at an intermediate tip part thereof. The resilient contact piece 13 is embossed to form a contact portion 20 projecting up and extending forward from the tip part. The resilient contact piece 13 is mounted into the main body 11 and pressed by the male terminal 90 inserted into the insertion space 23 of the main body 11 to be deformed resiliently in a state fixed to the bottom wall 14 by the crimping pieces 27.

As shown in FIG. 1, two protruding pieces 30 are provided on opposite side edges of the resilient contact piece 13 and protrude laterally at positions facing the contact portion 29. When the resilient contact piece 13 is arranged in the main body 11, the protruding pieces 30 are located in the confirmation holes 25 of the main body 11. A state of the resilient contact piece 13 can be confirmed by seeing the protruding pieces 30 through the confirmation holes 25 as shown in FIGS. 4 and 5.

Figure 2:
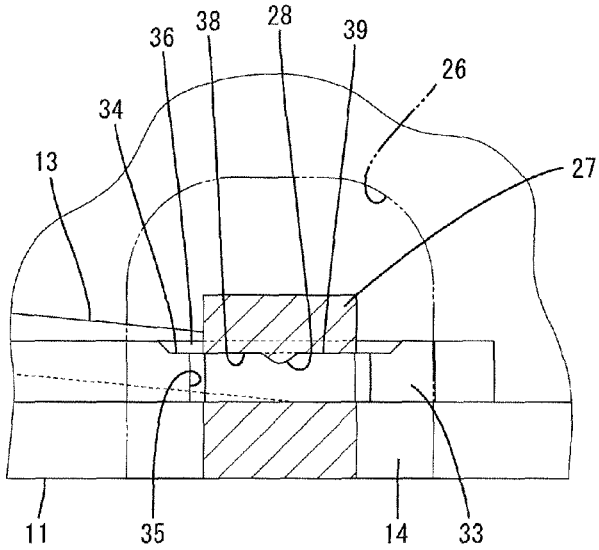
FIG. 2 is a section showing a state where a crimping piece is crimped and fixed to a crimping region.
Figure 7:
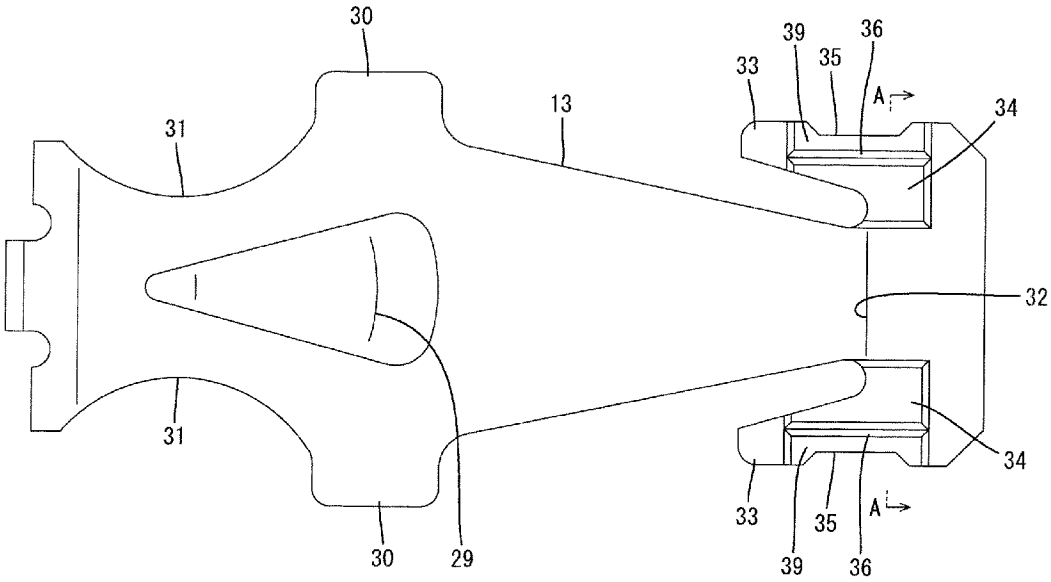
FIG. 7 is a plan view of a resilient contact piece.

As shown in FIG. 7, two arcuate recesses 31 are provided on parts of the opposite side edges of the resilient contact piece 13 before the both protruding pieces 30, and an intermediate part of a front part of the resilient contact piece 13 is narrowed by the recesses 31. Further, a rear part of the resilient contact piece 13 is narrowed gradually toward the back, and a support 32 for the deflection of the resilient contact piece 13 is provided on a narrowest rear end part. Further, two crimping regions 33 are provided on the rear end part of the resilient contact piece 13 and protrude toward opposite widthwise sides from positions behind the support 32. When the resilient contact piece 13 is arranged in the main body 11 as shown in FIG. 2, the crimping regions 13 are arranged in contact with the upper surface of the bottom wall 14 and the crimping pieces 27 are crimped and fixed to the crimping regions 33.

Figure 8:
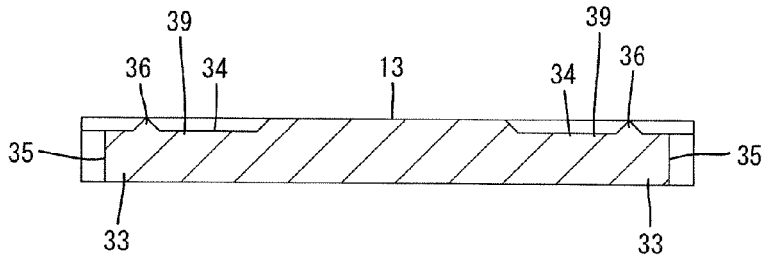
FIG. 8 is a section along A-A of FIG. 7.

As shown in FIG. 7, the crimping regions 33 project forward after protruding toward the opposite widthwise sides. Recesses 34 slightly lower than surrounding parts are provided on the upper crimping surfaces 39 for the crimping pieces 27 of the crimping regions 33, and the crimping pieces 27 are pressed into the recesses 34 as shown in FIG. 1. As shown in FIG. 8, the crimping regions 33 are made thinner than the surrounding parts at positions corresponding to the recesses 34 by press-working or cutting. Further, the outer edges of the crimping regions 33 are cut to form engaging recesses 35 into which the crimping pieces 27 are fit when crimped.

As shown in FIG. 7, a rib-like protrusion 36 is provided in the recess 34 of each of the crimping regions 33 on the side of the resilient contact piece 13 and extends in the front-back direction (inserting direction of the male terminal 90 into the main body 11). As shown in FIG. 8, the protrusion 36 has a triangular cross-section with an acute tip and extends over the entire length of the recess 34 in the front-back direction. The upper end of the protrusion 36 is arranged at a height substantially flush with the upper surface of the part surrounding the recess 34.

In assembling, the resilient contact piece 13 is placed on the bottom wall 14 of the main body 11 in the development state, as shown in FIG. 9. Subsequently, as shown in FIGS. 1, 4 and 6, the crimping pieces 27 of the main body 11 are bent, folded and crimped to the crimping regions 33 of the resilient contact piece 13. Thus, as shown in FIG. 2, the crimping surfaces 38, 39 of the crimping pieces 27 and the crimping regions 33 face each other. The protrusions 28 contact and bite into the crimping surfaces 39 of the crimping regions 33 along lines and the protrusions 36 contact and bite into the crimping surfaces 38 of the crimping pieces 27 along lines. In addition, due to the hardness difference between the resilient contact piece 13 and the main body 11, the protrusions 36 strongly bite into the protrusions 28, and the protrusions 28 are substantially squeezed by the protrusions 36. In this way, the resilient contact piece 13 is fixed strongly to the bottom wall 14. A hooking structure between the protrusions 28, 36 is formed in a direction substantially perpendicular to inserting and withdrawing directions of the male terminal 90 into and from the main body 11. Therefore, a displacement of the resilient contact piece 13 relative to the main body 11 is prevented when the male terminal 90 is inserted into and withdrawn from the main body 11 or loosely moves in the front-back direction. Note that the support 32 is located at the same position as or slightly behind the contact positions of the protrusions 28, 36 in the front-back direction, as shown in FIG. 1.

The male terminal 90 is inserted into the main body 11 after assembly of the terminal fitting 10 is completed. The male terminal 90 then contacts the contact portion 29 of the resilient contact piece 13 and the resilient contact piece 13 is deformed resiliently about the support 32. At this time, the contact portion 29 is displaced down by being pressed by the male terminal 90, and the front end of the resilient contact piece 13 is displaced forward while sliding on the upper surface of the bottom wall 14. In a state where the male terminal 90 is inserted properly in the main body 11, the male terminal 90 is sandwiched resiliently between the contact portion 29 and the receiving portion 24 and the terminal fitting 10 and the male terminal 90 are connected electrically.

As described above, the protrusions 28, 36 contact and bite into the crimping surfaces 39, 38 along lines. Thus, the resilient contact piece 13 is fixed strongly to the crimping pieces 27. As a result, a displacement of the resilient contact piece 13 relative to the main body 11 is suppressed and connection reliability of the terminal fitting 10 to the male terminal 90 is ensured.

There is a hardness difference between the main body 11 and the resilient contact piece 13 and the protrusions 36 are provided on the resilient contact piece 13 having a higher harness and bite into the crimping surfaces of the main body 11 having a lower hardness. Thus, fixing strength of the resilient contact piece 13 to the main body 11 is increased further.

The protrusions 28 are ribs that extend in the direction substantially perpendicular to the inserting and withdrawing directions of the male terminal 90 into and from the main body 11. Thus, a locking action of the protrusions 28 acts against the insertion and withdrawal of the male terminal 90 so that connection reliability to the male terminal 90 can be further improved.

In addition, the protrusions 28, 36 contact each other in an intersecting manner at the time of crimping, thereby forming the hooking structure between the protrusions 28, 36. Thus, displacements between the crimping pieces 27 and the crimping regions 33 are suppressed more satisfactorily.

The invention is not limited to the above described embodiment. For example, the following embodiments also are included in the scope of the invention.

The crimping pieces may be provided on the resilient contact piece instead of on the main body portion.

The protrusions may be omitted from the crimping regions or the protrusions may be omitted from the crimping pieces of the main body portion.

The protrusions need not necessarily extend in the direction perpendicular to the inserting direction of the male terminal and may extend obliquely with respect to the inserting direction.

The main body portion may be formed to have a higher hardness than the resilient contact piece.

REFERENCE SIGNS

10 . . . terminal fitting
11 . . . main body portion
13 . . . resilient contact piece
28 . . . protrusion (protrusion on main body portion side)
33 . . . crimping region
36 . . . protrusion (protrusion on resilient contact piece side)
38, 39 . . . crimping surface

What is claimed is:

1. A terminal fitting, comprising:

a substantially tubular main body into which a male terminal is to be inserted;

a resilient contact piece that is separate from the main body and deflectably arranged in the main body for resiliently contacting the male terminal in the main body;

a first of the main body and the resilient contact piece including at least one crimping piece with a first crimping surface to be crimped and fixed to a second crimping surface on a second of the main body and the resilient contact piece; and at least one protrusion formed on at least one the first and second crimping surfaces and biting into the first or second of the crimping surfaces opposed to the protrusion when the crimping piece is crimped.

2. The terminal fitting of claim 1, wherein the protrusion is a rib extending in a direction intersecting an inserting direction of the male terminal.

3. The terminal fitting of claim 1, wherein there is a hardness difference between the main body and the resilient contact piece.

4. The terminal fitting of claim 3, wherein the protrusion is provided at least on one of the main body and the resilient contact piece having a higher hardness.

5. The terminal fitting of claim 1, wherein the protrusion is provided on each of the crimping surfaces.

6. The terminal fitting of claim 5, wherein the protrusions define ribs that come into contact with each other in an intersecting manner after crimping.

7. The terminal fitting of claim 1, further comprising at least one confirmation hole penetrating the main body, and at least one protruding piece formed on the resilient contact piece, the resilient contact piece being arranged in the main body so that the protruding piece aligns at least partly with the confirmation hole of the main body, so that a state of the resilient contact piece can be confirmed by detecting the protruding piece through the confirmation hole.

8. The terminal fitting of claim 7, wherein the at least one protruding piece protrudes laterally at a position substantially facing a contact portion of the resilient contact piece with the male terminal.

9. The terminal fitting of claim 7, wherein the at least one protruding piece is provided at least a one side edge of the resilient contact piece.

10. The terminal fitting of claim 1, wherein at least one mold removal hole is provided in the main body in a position adjacent to the confirmation hole.

11. The terminal fitting of claim 10, wherein the crimping piece is a strip cantilevered from an inner edge toward an outer edge part of the mold removal hole in a width direction in a development state.

12. A terminal fitting, comprising:

a substantially tubular main body; and a resilient contact piece formed separate from the main body and deflectably arranged in the main body;

the main body including at least one crimping piece with a first crimping surface;

the resilient contact piece formed with second crimping surface crimped by the first crimping surface; and at least one protrusion formed on at least one the first and second crimping surfaces and biting into the first or second of the crimping surfaces opposed to the protrusion when the crimping piece is crimped.

13. The terminal fitting of claim 12, wherein there is a hardness difference between the main body and the resilient contact piece.

14. The terminal fitting of claim 12, wherein the protrusion is provided at least on one of the main body and the resilient contact piece having a higher hardness.

15. The terminal fitting of claim 12, wherein the protrusion is a rib.

16. The terminal fitting of claim 12, wherein each of the crimping surfaces has at least one of the protrusions.

17. The terminal fitting of claim 16, wherein the protrusions define ribs that come into contact with each other in an intersecting manner after crimping.

* * * * *